United States Patent [19]

Fantuzzo

[11] 4,142,655

[45] Mar. 6, 1979

[54] TONER DISPENSING AND SUPPLY ARRANGEMENT

[75] Inventor: Joseph Fantuzzo, Webster, N.Y.

[73] Assignee: Xerox Corporation, Stamford, Conn.

[21] Appl. No.: 802,164

[22] Filed: May 31, 1977

[51] Int. Cl.[2] ..... G03G 15/08

[52] U.S. Cl. ..... 222/318; 222/DIG. 1

[58] Field of Search ..... 222/1, 108, 318, 424, 222/DIG. 1; 198/659

[56] References Cited

U.S. PATENT DOCUMENTS

| | | | |
|---|---|---|---|
| 3,244,325 | 4/1966 | Lindquist | 222/318 X |
| 3,550,792 | 12/1970 | Stowell | 222/318 X |
| 3,726,392 | 4/1973 | Rastoin | 198/659 |
| 3,954,331 | 5/1976 | Smith | 222/DIG. 1 |

OTHER PUBLICATIONS

Jendrick, "Toner Dispenser"; Xerox Disclosure Journal, vol. 1, No. 1, Jan. 1976.

*Primary Examiner*—Joseph J. Rolla

[57] ABSTRACT

A dispensing hopper within the xerographic machine arranged to support a quantity of finely divided particulate material. The hopper is provided with a first reservoir with a dispensing opening through which the material is dispensed to a developer sump. A cylindrical dispensing roll or other control device is rotatably suported in the first reservoir in or adjacent the dispensing opening and the dispensing roll is rotated sequentially through the material in the first reservoir and past the dispensing opening to dispense toner into the developer chamber. The dispenser also includes a second reservoir adjacent the first reservoir into which toner in excess of a preselected amount is directed. A remote toner container is coupled to the dispensing hopper by a closed loop transport arrangement consisting of a first transport which continuously delivers toner from the remote container to the first reservoir at a rate in excess of that dispensed to the developer chamber, the excess toner falling into the second reservoir. A second transport removes toner from the second reservoir back to the remote toner supply container.

2 Claims, 2 Drawing Figures

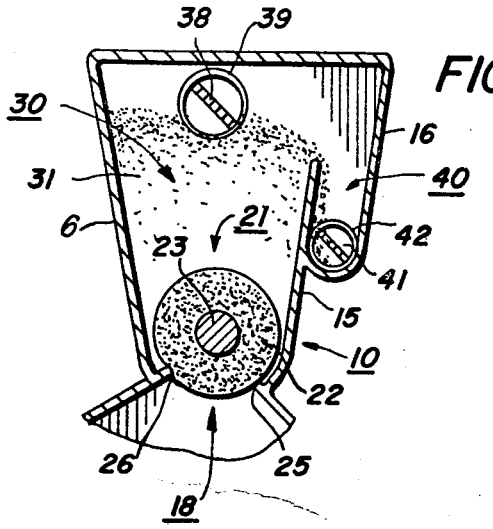
FIG. 2
FIG. 1
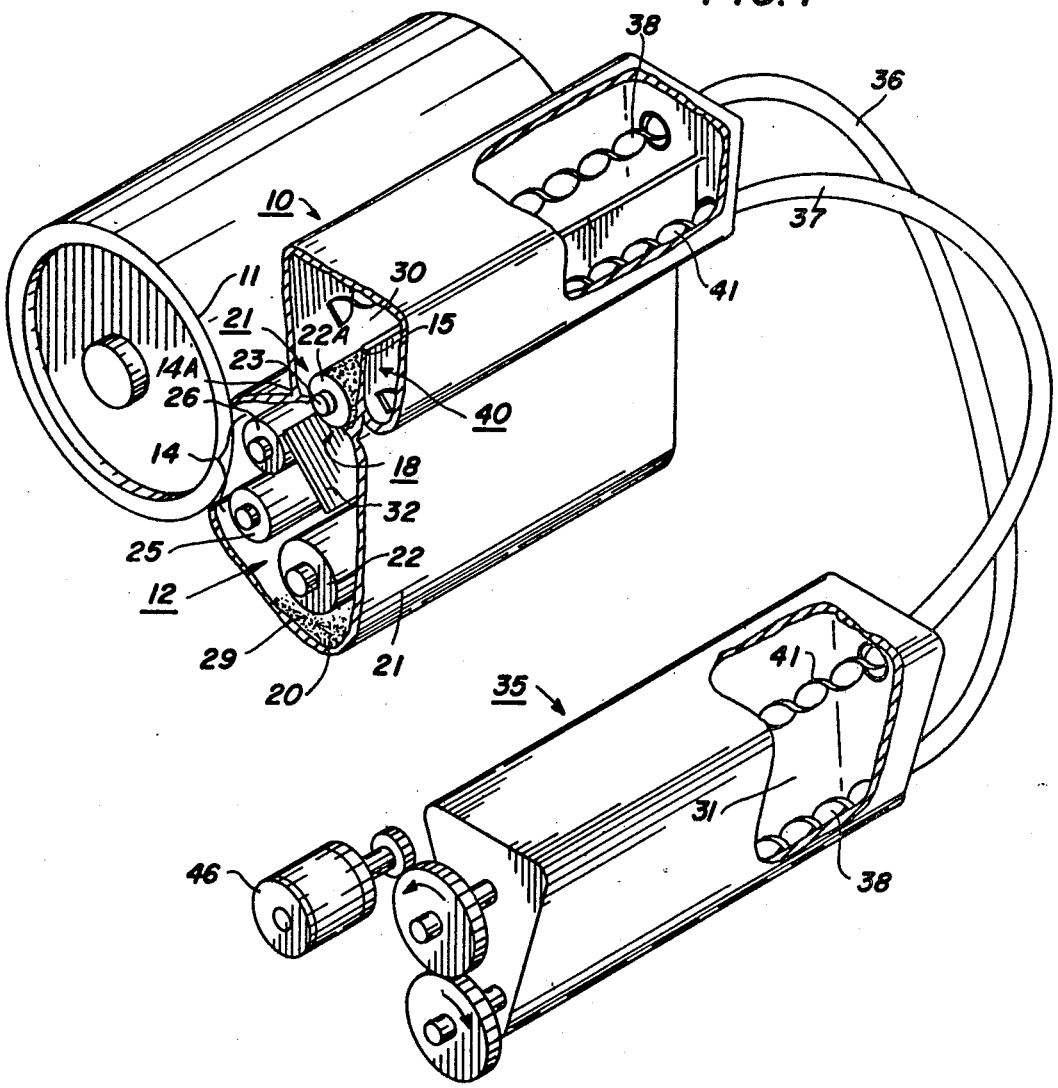

TONER DISPENSING AND SUPPLY ARRANGEMENT

BACKGROUND OF THE INVENTION

This invention relates to improvements in apparatus for dispensing finely divided powders or granular materials and, in particular, to improvements in xerographic toner dispensing apparatus. More specifically, this invention relates to a xerographic toner dispenser and resupply arrangement that is particularly adapted for use in conjunction with a remotely located toner reservoir.

Basically, in the art of xerography, a imaging member formed of a photoconductive surface carried on a conductive substrate is uniformly charged and the surface then exposed to a light image of an original which is to be copied. The photoconductive layer becomes conductive under the influence of the light image to selectively dissipate the charge found thereon thus forming a latent electrostatic image. To make this latent image visible a finely divided pigmented resin-based material, commonly referred to as toner, is first charged to a potential opposite to that of the latent electrostatic image and then while still in a charged state, brought into contact with the latent image whereby the charged toner particles are attracted and adhere to the image areas. The developer image may then usually transfer from the imaging member to a final support material and fixed thereto to form a permanent record of the original.

The resin-based toners employed in the practice of the xerographic process are generally blended from finely sub-divided materials to yield an extremely fine powder composition having an average particle size of about 10 microns. As used in most automatic xerographic reproducing apparatus, the fine toner particles are brought into rubbing contact with a triboelectrically remote and relatively coarser "carrier" material. The rubbing or mixing action causes the toner particles to become triboelectrically charged to a polarity opposite that of the carrier. The charged toner particles electrostatically coat themselves on the surface of the coarser carrier material and remain bonded there in a charged state. The two component material is then brought into contact with an image bearing photoconductive plate by one of several known techniques where the toner is electrostatically transferred from the carrier surface to the latent image areas to effect development. As can be seen, the coarser carrier particles not only provide a means for charging the toner material, but also provide a vehicle by which the toner particles are conveniently handled and transported in the xerographic development apparatus.

In order to sustain continuous operation in an automatic device, the toner material consumed in the development process must be periodically replaced within the development system. One arrangement for resupplying spent toner involves the use of a sealed toner cartridge or package which is placed into the xerographic machine when toner is depleted. The package usually includes a series of openings which are covered with an easily removable adhesive strip. The package is then inserted into a receiving portion of the machine generally above the developer sump and rotated to bring the openings to the 6 o'clock position. This dumps the entire contents of the package into a dispensing hopper from whence a controllable amount of toner is periodically added to the development system in accordance with an error signal developed in accordance with well known techniques. The package is left in the machine until a new package is needed to fill the hopper. This type of toner resupply arrangement is shown in U.S. Pat. Nos. 3,356,248, 3,339,807 and 3,385,500.

Dispensing of toner from the hopper of the above described arrangements may be accomplished by means of a toner dispensing foam roll in accordance with U.S. Pat. Nos. 3,596,807 or Re. 27,876.

As xerographic machines operate at faster speeds, a greater amount of toner must be supplied to the development system. Due to the limited space available within the machine, it becomes particularly desirable to store the toner in a reservoir or container outside the machine or remote from the development system and transport the toner into the machine as needed.

In addition, it is also desirable for most efficient dispensing of the toner utilizing gravity feed to provide a regulated head or mass of toner above the toner dispensing opening so that dispensation of toner into the development housing takes place at a uniform rate.

OBJECTS AND SUMMARY OF THE INVENTION

It is therefore a primary object of this invention to improve apparatus for handling and dispensing of finely divided particulate materials.

Another object is the provision of a toner dispenser which utilizes gravity loading or feed or toner into a development system in which a constant head of toner is maintained above the dispensing orifice.

A further object is the provision of a remote toner container, and suitable toner transport means coupled intermediate the remote supply and the toner dispenser to provide a continuous feed and removal of toner to the dispenser.

Yet another object is the provision of a toner dispenser which overcomes the disadvantages attendent to prior art dispensers.

These and other objects of the present invention are attained by means of a substantially enclosed dispensing hopper within the xerographic machine arranged to support a quantity of finely divided particulate material. The elongated hopper is provided with a first reservoir in fluid communication with an elongated dispensing opening through which the material is dispensed by gravity to a developer sump. A cylindrical dispensing roll or other control device is rotatably supported in the first reservoir in or adjacent the dispensing opening and means are operatively connected to the dispensing roll to rotate it sequentially through the material in the first reservoir and past the dispensing opening to dispense toner into the developer chamber.

The dispenser also includes a second reservoir adjacent the first reservoir into which toner in excess of a preselected amount is directed. A remote toner container is coupled to the dispensing hopper by a closed loop transport arrangement consisting of a first transport which continuously delivers toner from the remote container to the first reservoir at a rate in excess of that dispensed to the developer chamber, the excess toner falling into the second reservoir. A second transport removes toner from the second reservoir back to the remote toner supply container. The above operation provides a constant head of toner above the dispensing opening and results in a more uniform dispensation of toner into the developer chamber.

BRIEF DESCRIPTION OF THE DRAWINGS

FIG. 1 is an illustrative view of a conventional xerographic development system with the toner dispenser and supply arrangement of the invention incorporated therein, and FIG. 2 is a cross section view of the dispenser along the lines 2—2 of FIG. 1.

DESCRIPTION OF THE PREFERRED EMBODIMENT

Referring to FIG. 1 the dispenser 10 of the invention is shown for the sake of explanation as part of a conventional development system of the magnetic brush type. The dispenser may, of course, be incorporated into various other development systems well known in the art, as will become readily apparent hereinafter. The development system 12 operates to develop electrostatic latent images carried by an imaging surface 11. The construction of the xerographic imaging surface 11 and the remainder of the reproduction machine required to produce xerographic copy are well known in the art and will not be described herein in detail.

For the sake of completeness, a brief description of the representative development arrangement 12 will be given.

As shown, the development system 12 comprises a housing 21 in which is disposed a transport roll 22 and a series of applicator rolls 25 and 26 which cooperate to circulate developer material 20 along a path which runs from a sump 29 in the lower reaches of the housing 21, through a development zone 14, and then back to the sump 29 via return baffle 32. Suitable crossmixing vanes may be formed on the baffle 32 to mix the returning developer. The development zone 14 is located in the space intermediate the imaging surface 11 and the applicator rolls 25 and 26. In keeping with generally accepted practices, the developer material 20 comprises a mixture of triboelectrically charged toner particles and ferromagnetic carrier particles.

More particularly, in operation, developer material 20 is picked up from the sump 29 by transport roll assembly 22 and delivered to the lower applicator roll assembly 25 which advances the developer upwardly between the imaging surface 11 and successive ones of the applicator roll assemblies 25 and 26 through the development zone 14. To that end, the transport roll 22 and the applicator roll 25 and 26 are in the form of hollow non-magnetic sleeves which contain permanent magnets. The magnets and the sleeves typically extend across substantially the full width of the development zone 14. Moreover, the sleeves are rotatably driven (by means not shown) in the direction indicated by the arrows so that the developer material 20 magnetically entrained thereon under the influence of the magnetic fields provided by the magnets is transported, as above described, from the sump 29 to the last or uppermost applicator roll 26. After passing between that roll and the photoconductor 11, the developer is discharged onto the downwardly sloping ramp or baffle 32, which guides it back into the sump 29.

As is usually the case in development systems of this type, the sleeves of the applicator rolls are spaced a predetermined short distance from the photoconductor 11, and the magnetic fields emanating from the magnets contained therein are shaped to cause the developer on the sleeves to form bristle-like stacks or steamers which bridge that space. Hence, the developer brushes against the photoconductor 11 while passing between the photoconductor and each of the sleeves, thereby developing any latent images which happen to be present. Desirably, of course, there is a more or less uniform flow of developer across the full width of the development zone 14.

It is believed that the foregoing description is sufficient for purposes of the present application to show the general operation of the xerographic development apparatus employing a toner container and dispensing apparatus constructed in accordance with the present invention. Although not shown, suitable drive means are also provided to drive the imaging surface and other operating mechanisms at predetermined speeds relative to each other for proper machine operation. For further details concerning specific construction of the xerographic apparatus of the type shown herein, reference is had to U.S. Pat. No. 3,301,126 and U.S. Pat. No. 3,948,217.

The toner dispenser 10 includes a hopper 6 forming two toner reservoirs 30 and 40. The dispensing reservior 30 comprises two sidewalls 14A and 15 closed by end walls (not shown) to form a generally four sided sump generally trinagular in cross section.

The bottom portions of the sidewalls 14A and 15 are spaced apart to form a dispensing opening 18 in the bottom of the hopper 6. The sidewalls 14A and 15 are slightly inclined to direct toner in the reservoir 30 by gravity toward the dispensing opening 18.

The dispenser 10 further includes a dispensing roll assembly 21 constructed in accordance with the teachings of U.S. Pat. No. 3,596,807. The roll assembly 21 includes a cover 22A securely affixed to a shaft 23, as for example, by gluing, and the shaft is journaled for rotation in bearing blocks (not shown) provided in the lower end walls of the hopper 6. One end of shaft 23 extends through one end wall (not shown) of the hopper for coupling to a suitable drive means (not shown) to rotate the shaft 23.

The dispensing cover 22A may be formed from any number of foamed elastomeric materials having a textured open-celled surface structure made up of a mass of small hollow cavities capable of receiving and supporting a quantity of particulate material therein. Typical examples of foamable materials that can be formed in open-celled configurations are polyurethanes, polyvinyl chloride, silicones, polystyrenes, styrene acrylonitrile, cellulose acetate, and phenolics. A typical cover for use in the preferred embodiment of the present invention is one fabricated of a urethane foam.

The sidewalls 14A and 15 of the reservoir 30 further form two flanges or bosses 25 and 26 which abut the periphery of the cover 22A to ensure uniform toner dispensing across the width of the developer housing. The trimmer boss 25 ensures that the pores of the foam roll cover which are filled during rotation through the toner do not carry an excessive amount of toner. The dispensing boss 26 applies pressure to the cover forcing the trapped dry ink to leave the roll and fall by gravity into the developer sump. The operation of the bosses 25 and 26 in deforming the surface of the roll cover to load and unload toner is described in greater detail in the aforementioned patent.

In operation, as the foam roll 21 is rotated, the toner in the reservoir 30 is continuously loaded into the pores of the cover 21 on the hopper side of the roll, leveled by the trimmer boss 25, and forced to be expelled by boss 26 on the developer sump side of the roll.

The toner return reservoir 40 is defined by the common wall 15 and an outer wall 16 and is located to accept toner poured over or in excess of that able to be held by the dispenser reservoir 30.

A remote toner container 35, FIG. 1, is located in a position removed from the development housing 21, such as in a remote portion of the reproduction machine where space is at less of a premium than it is adjacent the xerographic process. Alternatively, the remote toner container 35 may be located outside the reproduction machine housing, perhaps carried on an outer wall of the machine to enable easier access by a machine operator. The latter arrangement would facilitate replenishment of toner material as needed. The shape of the remote container may, of course, vary from that shown in FIG. 1, since it is not critical to the operation of the disclosed arrangement.

A first flexible toner transport 36 is coupled between the lower portion of the remote container 35 and the dispenser reservoir 30 in the dispenser hopper 11 to move toner 31 from the remote container into the dispenser. A second flexible toner transport 37 is coupled between the lower portion of the return reservoir 40 and the upper portion of the remote container 35. The flexible transport 36 is comprised of flexible auger 38 located within a flexible tube 39. In a similar fashion, flexible transport 37 is comprised of flexible auger 41 located within a flexible tube 42. It should be understood that rigid toner transports may be employed in place of the flexible transports, but the latter have the advantage of allowing toner to be routed around obstructing machine components more easily. The flexible augers 38 and 41 may comprise coil springs. The augers may be driven from either end by suitable drive source such as motor 46.

In operation, the auger 38 is driven at a rate designed to move toner from the container 35 into the dispensing reservoir 30 at a rate greater than that at which it is being dispensed from the reservoir 30 by the dispenser roll 21. This excessive delivery rate eventually results in the reservoir 30 filling up with toner above the level of the common wall 15, as shown in FIG. 2. After this point is reached further toner delivery to the reservoir 30 results in toner spilling over the wall 15 into the return reservoir 40 from whence the auger transport 37 returns it to the remote toner container 35. The auger 41 is driven at a rate sufficient to prevent the build up of toner in the reservoir 40 above the height of the wall 15.

Summarizing the process of the invention, toner 31 from a remote toner container is continuously delivered to a fixed volume dispensing reservoir of a toner dispenser at a rate in excess of the rate at which toner is being added to the development system. The above action leads to the creation of a spillover or excess toner flow and this overflow is collected in a return reservoir from which toner is continuously withdrawn back to the remote toner container. Flexible auger transports serve to move toner to and from the dispenser. The spillover arrangement comprises adjacent reservoirs sharing a common wall, the level of the common wall operating to maintain a constant toner level in the reservoir and to direct excess toner into the return reservoir. The height of the common wall must, of course be lower than the height of the other reservoir walls in order to operate in the manner described, but the exact height is preselected to result in a uniform dispensing rate from the dispenser roll.

Thus, toner 31 is continuously delivered to the dispenser 10 and withdrawn therefrom. The toner 31 in reservoir 30 in time reaches a preselected level at approximately the height of wall 65 and is thereafter maintained at this approximate level by the continuous feed and return of toner.

Since many changes can be made in the above construction and many widely different specific embodiments of this invention could be made without departing from the teaching thereof, it is intended that all matters contained herein be interpreted as illustrative and not in a limiting sense.

What is claimed is:

1. A toner dispensing and resupply arrangement for dispensing toner to a development system of a xerographic machine, comprising a toner dispenser including a hopper formed into two toner reservoirs, one of said reservoirs including an opening and means for dispensing toner through said opening into said development system, a remote toner container, a first auger transport for continuously delivering toner to said one toner reservoir from said container at a rate in excess of the rate at which toner is dispensed into said development system to thereby create a toner overflow, said other reservoir arranged to accept said overflow and a second auger transport in said other reservoir to return said overflow to said container.

2. The combination recited in claim 1 wherein said reservoirs are adjacent each other and separated by a common wall over which said overflow toner spills.

* * * * *